US010211002B2

(12) United States Patent
Hofmann

(10) Patent No.: US 10,211,002 B2
(45) Date of Patent: Feb. 19, 2019

(54) LOCKING APPARATUS FOR A CIRCUIT BREAKER

(71) Applicant: Siemens Aktiengesellschaft, Munich (DE)

(72) Inventor: Michael Hofmann, Rieden (DE)

(73) Assignee: SIEMENS AKTIENGESELLSCHAFT, Munich (DE)

( * ) Notice: Subject to any disclaimer, the term of this patent is extended or adjusted under 35 U.S.C. 154(b) by 0 days.

(21) Appl. No.: 15/620,877

(22) Filed: Jun. 13, 2017

(65) Prior Publication Data

US 2017/0358401 A1 Dec. 14, 2017

(30) Foreign Application Priority Data

Jun. 14, 2016 (DE) ..... 10 2016 210 486

(51) Int. Cl.
*H01H 9/28* (2006.01)
*H01H 9/26* (2006.01)

(52) U.S. Cl.
CPC ..... *H01H 9/285* (2013.01); *H01H 9/26* (2013.01); *H01H 9/286* (2013.01); *H01H 2300/018* (2013.01)

(58) Field of Classification Search
CPC ..... H01H 9/285; H01H 9/286
USPC ..... 200/43.11, 43.14, 43.01, 43.16, 43.19, 200/43.21, 5 B, 50.01, 50.32–50.5
See application file for complete search history.

(56) References Cited

U.S. PATENT DOCUMENTS 4,575,590 A * 3/1986 Hattori ..... H01H 13/568 200/5 B

* cited by examiner

*Primary Examiner* — Edwin A. Leon
*Assistant Examiner* — Lheiren Mae A Caroc
(74) *Attorney, Agent, or Firm* — Harness, Dickey & Pierce, P.L.C.

(57) ABSTRACT

A locking apparatus for a circuit breaker includes a locking pin including a main body; a rotatably or displaceably mounted definition tip; and a guide including a mating contour. In an embodiment, the locking pin is movably mounted within the guide. The definition tip is in alignment with the locking pin in a first position, such that the locking pin together, with the definition tip, is movable through the guide. Further, the definition tip cannot be moved through the guide in a second position, owing to the deflection of the rotatably and displaceably mounted definition tip of the locking pin.

16 Claims, 6 Drawing Sheets

LOCKING APPARATUS FOR A CIRCUIT BREAKER

PRIORITY STATEMENT

The present application hereby claims priority under 35 U.S.C. § 119 to German patent application number DE 102016210486.1 filed Jun. 14, 2016, the entire contents of which are hereby incorporated herein by reference.

FIELD

At least one embodiment of the invention generally relates to a locking apparatus for a circuit breaker, and/or to an electrical switch having a locking apparatus of this kind and/or to an apparatus comprising two electrical switches of this kind.

BACKGROUND

Installations which are fed by two supply voltages from usually two different sources are increasingly being constructed in low-voltage installations. These two different sources can be, for example, a regular power supply system and a generator supply system. In order to prevent uncontrolled feeding, different apparatuses and devices are provided which ensure that only one individual feed source is active since otherwise the low-voltage installation could suffer severe damage.

In the field of circuit breakers, rear-side locks, for example, are used for this purpose, the rear-side locks being able to prevent uncontrolled connection of a further supply voltage.

The construction of these rear-side locks is generally realized by way of a rocker, wherein there is a locking lever (interlock plunger) on each rocker side, the locking lever, by virtue of one circuit breaker being switched on, being moved into the switching mechanism of the other circuit breaker and thereby ensuring that the other circuit breaker cannot be closed. A circuit breaker can no longer be switched on owing to the locking lever being extended.

SUMMARY

The inventor recognizes that typical locking apparatuses, for securely locking the respective circuit breaker, block the circuit breaker in a force-fitting manner. As a result, the mechanical loading and wear on the locking components of typical locking apparatuses are high and the system becomes unreliable.

At least one embodiment of the invention provides an alternative locking apparatus with a low level of wear and a high degree of reliability.

At least one embodiment of the invention is directed to a locking apparatus for a circuit breaker. Advantageous refinements of the locking apparatus according to the invention are specified in the claims. At least one embodiment of the invention is directed to an electrical switch. Advantageous refinements of the electrical switch according to the invention are specified in the claims. At least one embodiment of the invention is directed to an apparatus.

The locking apparatus according to an embodiment of the invention for a circuit breaker includes a locking pin having a main body and having a rotatably or displaceably mounted definition tip, and a guide with a mating contour, wherein the locking pin is movably mounted within the guide, wherein the definition tip is in alignment with the locking pin in a first position, so that the locking pin, together with the definition tip, can be moved through the guide, and wherein the definition tip cannot be moved through the guide in a second position owing to the deflection of the rotatably or displaceably mounted definition tip of the locking pin.

The electrical switch of at least one embodiment comprises a switching mechanism having a moving switching element, and comprises a locking apparatus according to the invention, wherein the moving switching element comprises a definition disk which interacts with the locking apparatus, so that, in the event of locking, the definition disk moves the definition tip of the locking apparatus to the second position.

The apparatus according to an embodiment of the invention has a first electrical switch according to an embodiment of the invention and a second electrical switch according to an embodiment of the invention and a rocker which connects the first locking pin to the second locking pin and ensures that only one of the two definition tips can be moved to the second position in each case.

BRIEF DESCRIPTION OF THE DRAWINGS

The properties, features and advantages of this invention that are described above and also the way in which they are achieved will become clearer and more distinctly comprehensible in connection with the following description of the example embodiments which will be explained in greater detail in connection with the figures.

DETAILED DESCRIPTION OF THE EXAMPLE EMBODIMENTS

Figure 1:
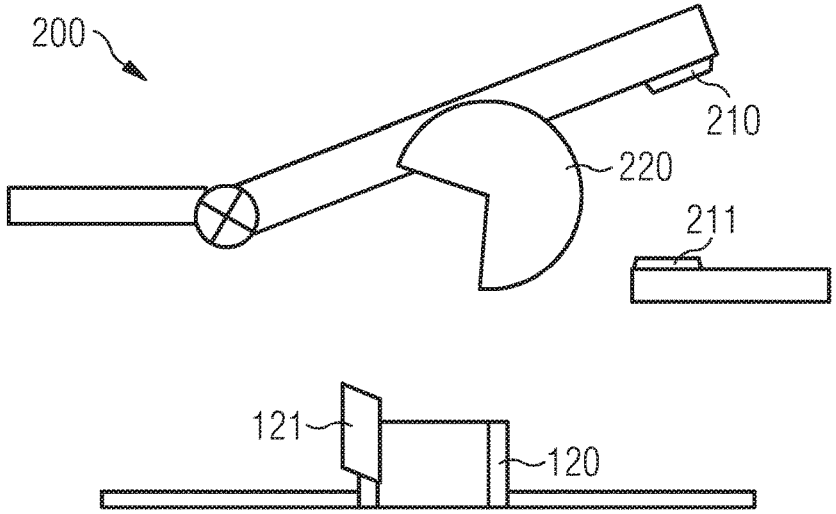
FIG. 1 shows an electrical switch with a moving electrical contact and a guide with a mating contour of the locking apparatus.

In the following, embodiments of the invention are described in detail with reference to the accompanying drawings. It is to be understood that the following description of the embodiments is given only for the purpose of illustration and is not to be taken in a limiting sense. It should be noted that the drawings are to be regarded as being schematic representations only, and elements in the drawings are not necessarily to scale with each other. Rather, the representation of the various elements is chosen such that their function and general purpose become apparent to a person skilled in the art.

The drawings are to be regarded as being schematic representations and elements illustrated in the drawings are not necessarily shown to scale. Rather, the various elements are represented such that their function and general purpose become apparent to a person skilled in the art. Any connection or coupling between functional blocks, devices, components, or other physical or functional units shown in the drawings or described herein may also be implemented by an indirect connection or coupling. A coupling between components may also be established over a wireless connection. Functional blocks may be implemented in hardware, firmware, software, or a combination thereof.

Various example embodiments will now be described more fully with reference to the accompanying drawings in which only some example embodiments are shown. Specific structural and functional details disclosed herein are merely representative for purposes of describing example embodiments. Example embodiments, however, may be embodied in various different forms, and should not be construed as being limited to only the illustrated embodiments. Rather, the illustrated embodiments are provided as examples so that this disclosure will be thorough and complete, and will fully convey the concepts of this disclosure to those skilled in the art. Accordingly, known processes, elements, and techniques, may not be described with respect to some example embodiments. Unless otherwise noted, like reference characters denote like elements throughout the attached drawings and written description, and thus descriptions will not be repeated. The present invention, however, may be embodied in many alternate forms and should not be construed as limited to only the example embodiments set forth herein.

It will be understood that, although the terms first, second, etc. may be used herein to describe various elements, components, regions, layers, and/or sections, these elements, components, regions, layers, and/or sections, should not be limited by these terms. These terms are only used to distinguish one element from another. For example, a first element could be termed a second element, and, similarly, a second element could be termed a first element, without departing from the scope of example embodiments of the present invention. As used herein, the term "and/or," includes any and all combinations of one or more of the associated listed items. The phrase "at least one of" has the same meaning as "and/or".

Spatially relative terms, such as "beneath," "below," "lower," "under," "above," "upper," and the like, may be used herein for ease of description to describe one element or feature's relationship to another element(s) or feature(s) as illustrated in the figures. It will be understood that the spatially relative terms are intended to encompass different orientations of the device in use or operation in addition to the orientation depicted in the figures. For example, if the device in the figures is turned over, elements described as "below," "beneath," or "under," other elements or features would then be oriented "above" the other elements or features. Thus, the example terms "below" and "under" may encompass both an orientation of above and below. The device may be otherwise oriented (rotated 90 degrees or at other orientations) and the spatially relative descriptors used herein interpreted accordingly. In addition, when an element is referred to as being "between" two elements, the element may be the only element between the two elements, or one or more other intervening elements may be present.

Spatial and functional relationships between elements (for example, between modules) are described using various terms, including "connected," "engaged," "interfaced," and "coupled." Unless explicitly described as being "direct," when a relationship between first and second elements is described in the above disclosure, that relationship encompasses a direct relationship where no other intervening elements are present between the first and second elements, and also an indirect relationship where one or more intervening elements are present (either spatially or functionally) between the first and second elements. In contrast, when an element is referred to as being "directly" connected, engaged, interfaced, or coupled to another element, there are no intervening elements present. Other words used to describe the relationship between elements should be interpreted in a like fashion (e.g., "between," versus "directly between," "adjacent," versus "directly adjacent," etc.).

The terminology used herein is for the purpose of describing particular embodiments only and is not intended to be limiting of example embodiments of the invention. As used herein, the singular forms "a," "an," and "the," are intended to include the plural forms as well, unless the context clearly indicates otherwise. As used herein, the terms "and/or" and "at least one of" include any and all combinations of one or more of the associated listed items. It will be further understood that the terms "comprises," "comprising," "includes," and/or "including," when used herein, specify the presence of stated features, integers, steps, operations, elements, and/or components, but do not preclude the presence or addition of one or more other features, integers, steps, operations, elements, components, and/or groups thereof. As used herein, the term "and/or" includes any and all combinations of one or more of the associated listed items. Expressions such as "at least one of," when preceding a list of elements, modify the entire list of elements and do not modify the individual elements of the list. Also, the term "exemplary" is intended to refer to an example or illustration.

When an element is referred to as being "on," "connected to," "coupled to," or "adjacent to," another element, the element may be directly on, connected to, coupled to, or adjacent to, the other element, or one or more other intervening elements may be present. In contrast, when an element is referred to as being "directly on," "directly connected to," "directly coupled to," or "immediately adjacent to," another element there are no intervening elements present.

It should also be noted that in some alternative implementations, the functions/acts noted may occur out of the order noted in the figures. For example, two figures shown in succession may in fact be executed substantially concurrently or may sometimes be executed in the reverse order, depending upon the functionality/acts involved.

Unless otherwise defined, all terms (including technical and scientific terms) used herein have the same meaning as commonly understood by one of ordinary skill in the art to which example embodiments belong. It will be further understood that terms, e.g., those defined in commonly used dictionaries, should be interpreted as having a meaning that is consistent with their meaning in the context of the relevant art and will not be interpreted in an idealized or overly formal sense unless expressly so defined herein.

Before discussing example embodiments in more detail, it is noted that some example embodiments may be described with reference to acts and symbolic representations of operations (e.g., in the form of flow charts, flow diagrams, data flow diagrams, structure diagrams, block diagrams, etc.) that may be implemented in conjunction with units and/or devices discussed in more detail below. Although discussed in a particularly manner, a function or operation specified in a specific block may be performed differently from the flow specified in a flowchart, flow diagram, etc. For example, functions or operations illustrated as being performed serially in two consecutive blocks may actually be performed simultaneously, or in some cases be performed in reverse order. Although the flowcharts describe the operations as sequential processes, many of the operations may be performed in parallel, concurrently or simultaneously. In addition, the order of operations may be re-arranged. The processes may be terminated when their operations are completed, but may also have additional steps not included in the figure. The processes may correspond to methods, functions, procedures, subroutines, subprograms, etc.

Specific structural and functional details disclosed herein are merely representative for purposes of describing example embodiments of the present invention. This invention may, however, be embodied in many alternate forms and should not be construed as limited to only the embodiments set forth herein.

Although described with reference to specific examples and drawings, modifications, additions and substitutions of example embodiments may be variously made according to the description by those of ordinary skill in the art. For example, the described techniques may be performed in an order different with that of the methods described, and/or components such as the described system, architecture, devices, circuit, and the like, may be connected or combined to be different from the above-described methods, or results may be appropriately achieved by other components or equivalents.

The locking apparatus according to an embodiment of the invention for a circuit breaker includes a locking pin having a main body and having a rotatably or displaceably mounted definition tip, and a guide with a mating contour, wherein the locking pin is movably mounted within the guide, wherein the definition tip is in alignment with the locking pin in a first position, so that the locking pin, together with the definition tip, can be moved through the guide, and wherein the definition tip cannot be moved through the guide in a second position owing to the deflection of the rotatably or displaceably mounted definition tip of the locking pin.

An advantage of this is that, owing to the redirection of force onto the guide or the mating contour of the guide in the second position, the mechanism of the rear-side locking modules is subjected to less loading than in the case of force-fitting solutions. The force is quickly braked over a short distance in a form-fitting manner. It is necessary only for the rotatably or displaceably mounted definition tip to be of stable construction and, nevertheless, no wear on the rest of the mechanism is to be expected. The locking apparatus according to the invention can be constructed such that required insulation aspects of voltage-carrying parts in the switching mechanism of a circuit breaker can be of very simple design. Similarly, it is possible to maintain air gaps and creepage distances in a more simple manner than in the case of conventional solutions.

In one embodiment, the definition tip can be moved to the second position when only the main body, and not the definition tip, is located within the guide.

In a further embodiment, in the second position, the locking pin is blocked in the guide by the contact between the definition tip and the mating contour of the guide.

In one embodiment, the locking pin comprising the main body and the definition tip is of cylindrical design in the first position.

In a further embodiment, the definition tip is of conical design on that side which is averted from the main body.

The electrical switch of at least one embodiment comprises a switching mechanism having a moving switching element, and comprises a locking apparatus according to the invention, wherein the moving switching element comprises a definition disk which interacts with the locking apparatus, so that, in the event of locking, the definition disk moves the definition tip of the locking apparatus to the second position.

In one embodiment of the electrical switch, the moving switching element is a moving electrical contact or a switching shaft.

In one embodiment, the moving switching element cannot be closed in the second position of the definition tip.

In a further embodiment, the definition tip, in its second position, is arranged between the moving switching element and the mating contour of the guide.

In one embodiment, the moving switching element cannot be closed in the second position of the definition tip since the locking pin is blocked in the guide by the contact between the definition tip and the mating contour of the guide.

The apparatus according to an embodiment of the invention has a first electrical switch according to an embodiment of the invention and a second electrical switch according to an embodiment of the invention and a rocker which connects the first locking pin to the second locking pin and ensures that only one of the two definition tips can be moved to the second position in each case.

The switching mechanism 200 of an electrical switch 500 is illustrated in FIG. 1. The switching mechanism 200 comprises a moving electrical contact 210 which interacts with a fixed electrical contact 211. In accordance with the illustration of FIG. 1, the switching mechanism 200 is open, so that no current can flow. The switching mechanism 200 additionally comprises a definition disk 220.

In general, the switching element 210 can be a moving electrical contact 210 or a switching shaft which is rotated in order to open or close the electrical switch 500.

A guide 120 with a mating contour 121 is likewise illustrated in FIG. 1. The guide 120 and the mating contour 121 are part of a locking apparatus 100. The guide 120 can be part of a housing of an electrical switch 500, for example can be formed in a rear side of the housing.

Figure 2:
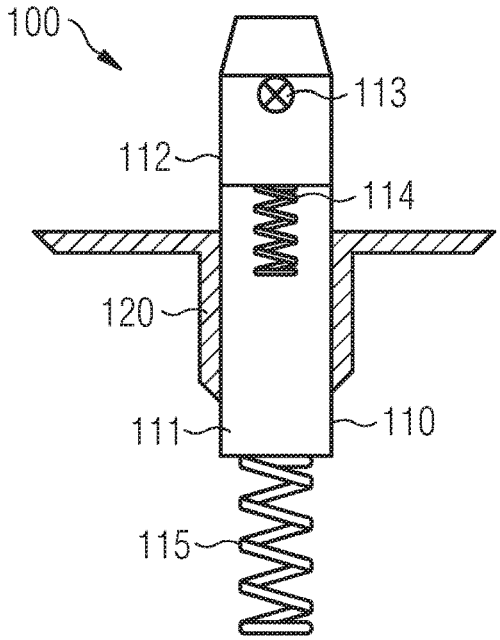
FIG. 2 shows a locking pin having a main body and a definition tip in the guide.

Further parts of the locking apparatus 100 are illustrated in FIG. 2. The locking apparatus 100 comprises a locking pin 110 which comprises a main body 111 and a rotatably mounted definition tip 112. Furthermore, the locking apparatus 100 comprises a guide 120.

The rotatably mounted definition tip 112 can be pivoted about an axis 113. According to FIG. 2, the definition tip 112 is in a first position. In this first position, the definition tip is in alignment with the locking pin 110, so that the locking pin 110, together with the definition tip 112, can be moved through the guide 120.

The possible movement of the locking pin 110 is a vertical movement in accordance with the illustration of FIG. 2. The movement can additionally be subjected to the action of a spring 115 which pushes the locking pin 110 either upward or downward. Furthermore, the locking pin comprises a spring 114 which ensures that the definition tip 112 is moved to the first position. Therefore, the rotatably mounted definition tip 112 is moved to the first position in which the definition tip 112 is in alignment with the locking pin 110. The definition tip 112 can be deflected against the force of the spring 114 only by interaction of the definition tip with a further body.

A deflection of the definition tip 112 to the second position is only possible when only the main body 111, and not the definition tip 112, is located within the guide 120. This is the case, by way of example, in the illustration of FIG. 2; deflection or movement of the definition tip to the second position would be possible here.

Figure 6:
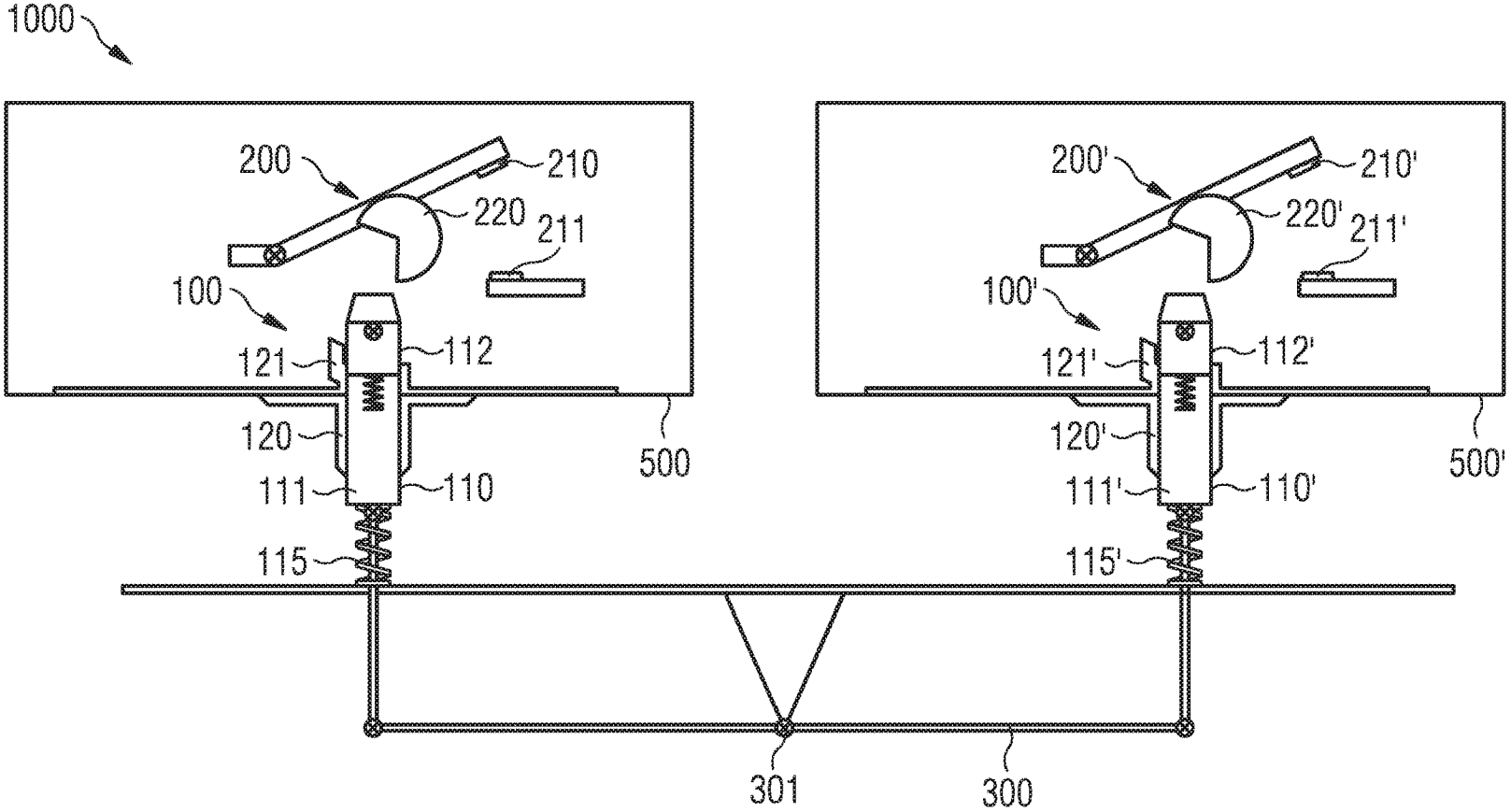
FIG. 6 shows an apparatus comprising a first electrical switch and a second electrical switch having a first locking apparatus and a second locking apparatus and a rocker.
Figure 7A:
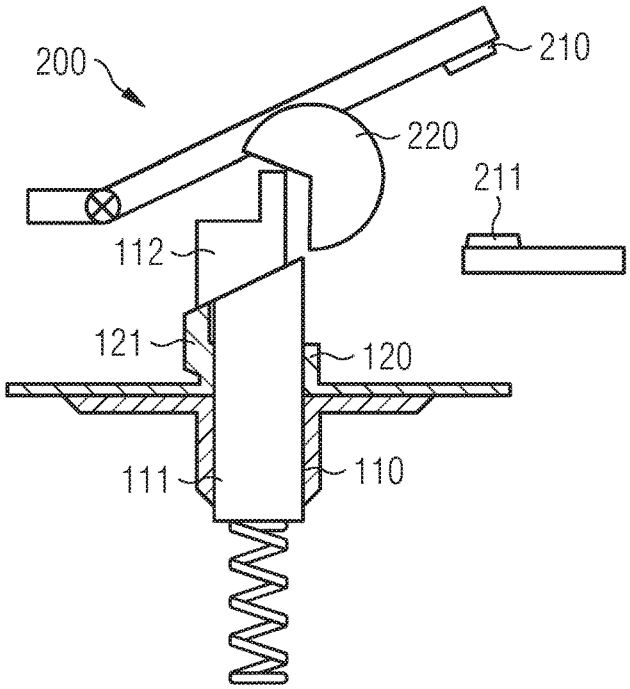
FIGS. 7A/7B show a first electrical switch having a first locking apparatus and a second electrical switch having a second locking apparatus, wherein the first electrical switch is blocked, and rotatably mounted definition tips.
Figure 7B:
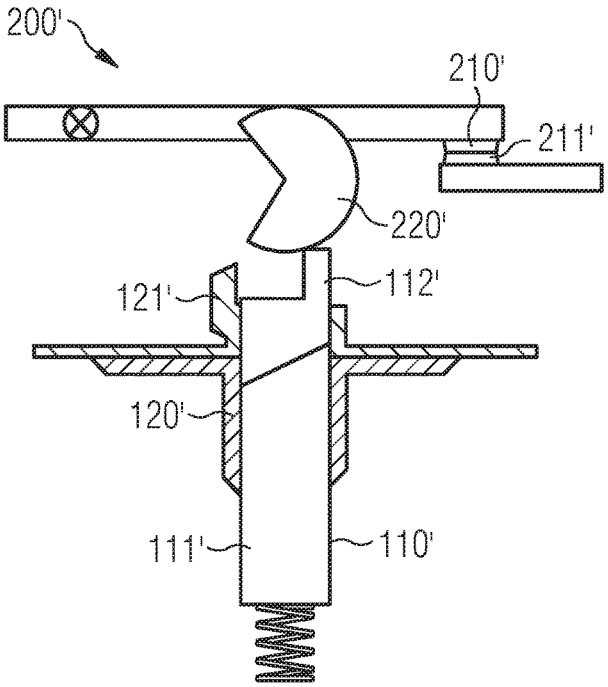

FIG. 6 shows an apparatus 1000 comprising a first electrical switch 500 and a second electrical switch 500' and a rocker 300 which connects the first locking pin 110 to the second locking pin 110' and ensures that only one of the two definition tips 112; 112' can be moved to the second position in each case. The rocker 300 is rotatably mounted about an axis 301. According to the illustration of FIG. 6, neither of the two definition tips 112; 112' can be moved to the second position. The individual positions of the definition tips 112; 112' are illustrated in FIGS. 3A, 3B, 4A, 4B and 5A, 5B.

Figure 3A:
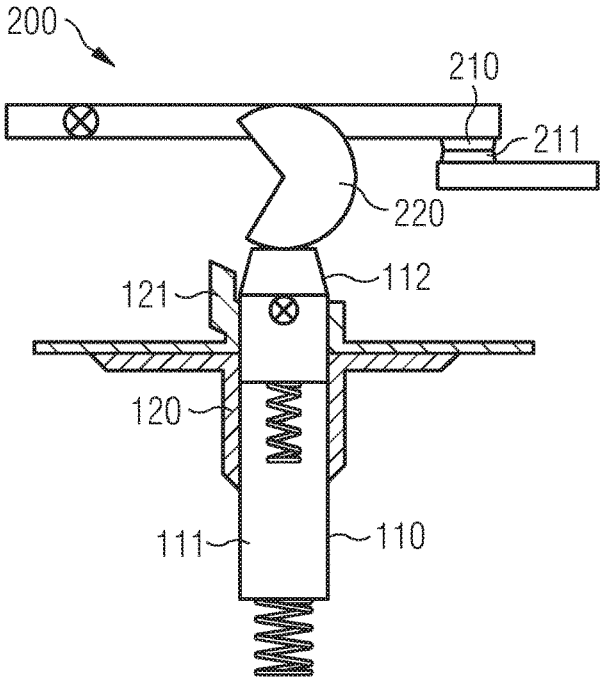
FIGS. 3A/3B show a first electrical switch having a first locking apparatus and a second electrical switch having a second locking apparatus, wherein the second electrical switch is blocked.
Figure 3B:
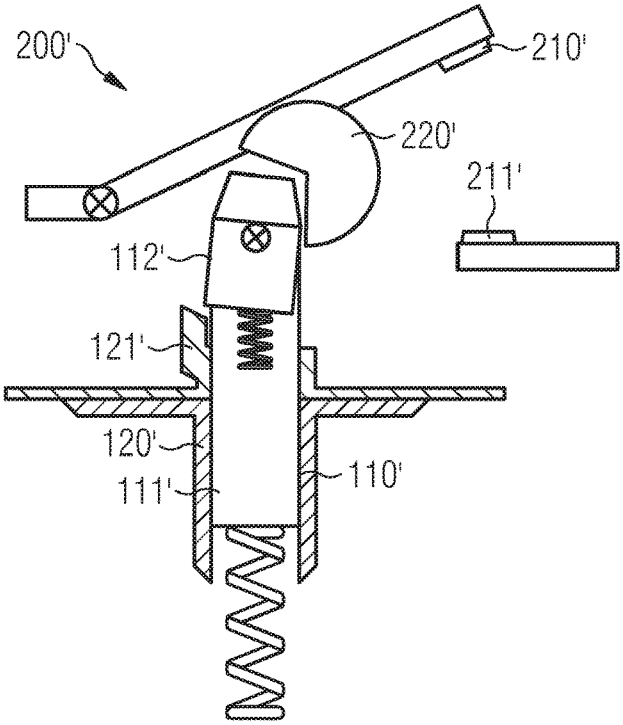

In FIGS. 3A and 3B, the first locking pin 110 has been moved downward and the second locking pin 110' has been moved upward in accordance with the illustration. The switching mechanism 200 of the first switch 500 has been closed, so that the moving electrical contact 210 electrically interacts with the fixed electrical contact 211. The first definition disk 220 directly mechanically interacts with the first locking pin 110. On account of the electrical contacts being closed, the first definition disk 220 has moved the pin downward and, by way of the rocker 300, the second locking pin 110' has been automatically moved upward.

The contour of the second definition disk 220' has the effect that, when an attempt is made to close the electrical contacts of the second switching mechanism 200', the definition tip 112' is mechanically deflected. According to the illustration of FIG. 3B, the definition tip 112' is rotated in the clockwise direction. Owing to the rotary movement of the definition tip 112', the definition tip 112' is deflected when the moving electrical contact 210' is further operated in the closing direction (that is to say downward in the illustration of FIG. 3B), so that mechanical blocking is established owing to the mechanical contact between the second definition tip 112' and the second mating contour 121' of the guide 120'. This prevents the second switching mechanism 200' from being closed. Therefore, only one of the two electrical switching mechanisms 200; 200' can be closed.

Figure 4A:
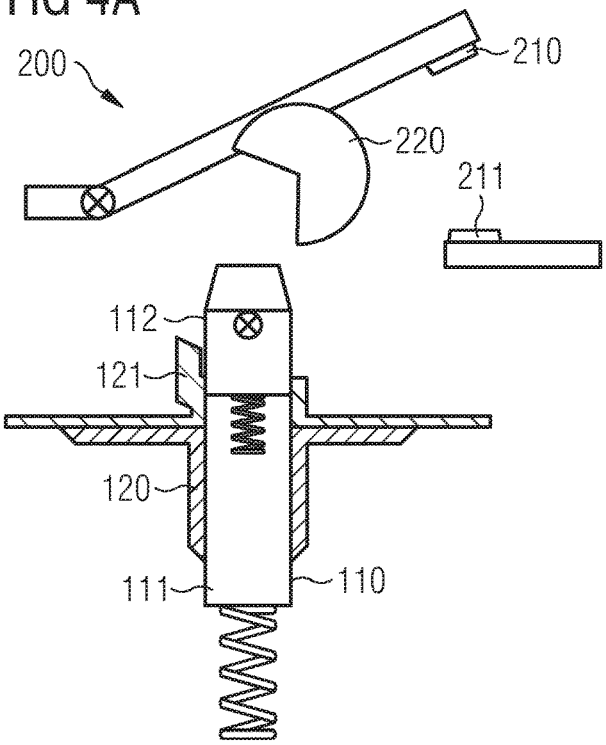
FIGS. 4A/4B show a first electrical switch having a first locking apparatus and a second electrical switch having a second locking apparatus and both locking pins in the neutral position.
Figure 4B:
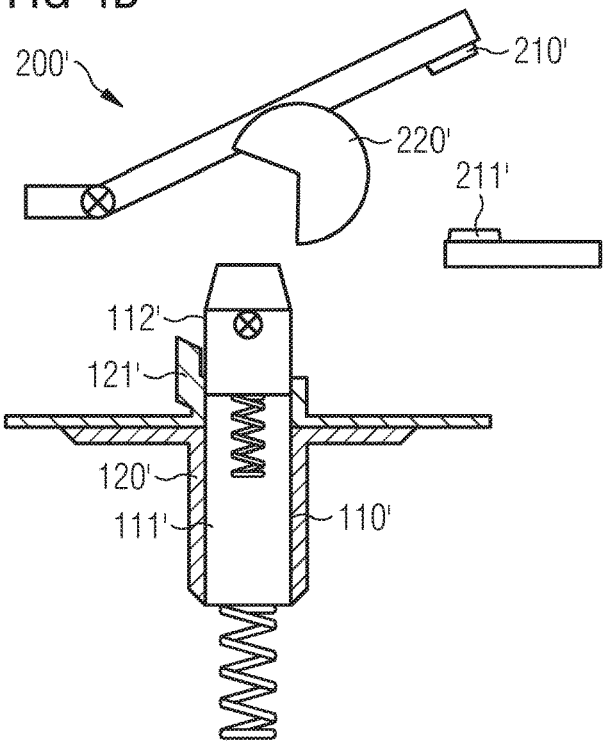
Figure 5A:
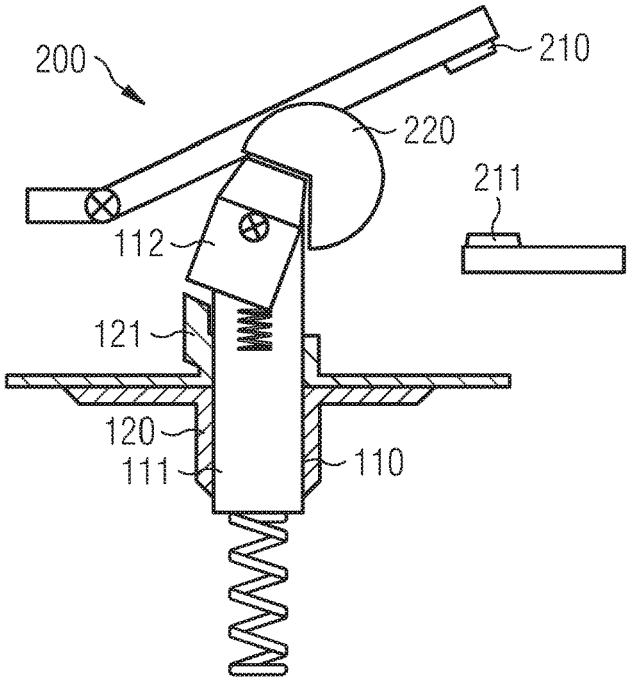
FIGS. 5A/5B show a first electrical switch having a first locking apparatus and a second electrical switch having a second locking apparatus, wherein the first electrical switch is blocked.
Figure 5B:
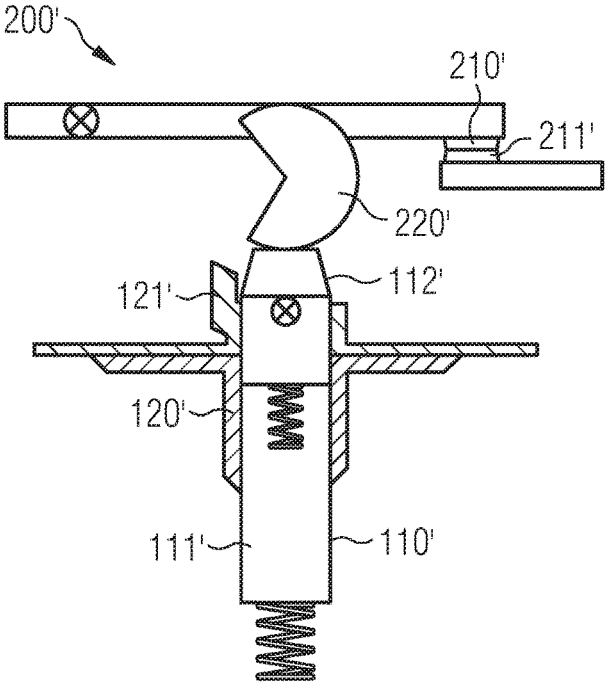

FIGS. 4A and 4B show the switching mechanisms 200; 200' of the first electrical switch 500 and, respectively, of the second electrical switch 500' in the neutral position. Both switching mechanisms 200; 200' are open and could be electrically closed.

In contrast to FIGS. 3A and 3B, FIGS. 5A and 5B show that, in the first electrical switch 500 having the first switching mechanism 200 and the first locking apparatus 100, the definition tip 112 has been deflected and therefore moved to the second position. The locking pin 110 is blocked in the guide 120 by the mechanical contact between the definition tip 112 and the mating contour 121 of the guide 120. The rest of the mechanism is not subjected to further mechanical loading owing to the form-fitting connection of the definition tip 112 and the mating contour 121.

The switching mechanism 200' of the second electrical switch 500' is electrically closed, so that the moving electrical contact 210' is electrically connected to the fixed electrical contact 211'. The definition disk 220' has moved the locking pin 110' downward in accordance with the illustration of FIG. 5B. The locking pin 110 of FIG. 5A has been moved upward on account of the rocker 300. This also ensures that only one of the two electrical switches 500; 500' can be closed. In accordance with FIGS. 5A and 5B, the one electrical switch is only the second electrical switch 500' having the second switching mechanism 200'.

In the illustrations of FIGS. 1 to 6, the locking pin 110 comprising the main body 111 and the definition tip 112 is of cylindrical design in the first position. The definition tip 112 is of conical design on those sides which are averted from the main body 111.

The definition tip 112, in its second position, is arranged between the moving electrical contact 210 and the mating contour 121, so that the movement of the locking pin 110 is blocked in the downward direction in accordance with FIGS. 1 to 6.

In contrast to FIGS. 3A and 3B, FIGS. 7A and 7B show that, in the first electrical switch 500 having the first switching mechanism 200 and the first locking apparatus 100, the definition tip 112 has been deflected in a displaceable manner and therefore moved to the second position. The locking pin 110 is blocked in the guide 120 by the mechanical contact between the definition tip 112 and the mating contour 121 of the guide 120. The rest of the mechanism is not subjected to further mechanical loading owing to the form-fitting connection of the definition tip 112 and the mating contour 121.

The first definition tip 112 and the second definition tip 112' are of displaceable design. In this case, the displacement force is exerted via one of the two definition disks 220; 220'; the one disk is the definition disk 220 in accordance with FIGS. 7A and 7B. A mechanism ensures that the definition tips 112; 112' are moved to the respective first position without the mechanical influence of the two definition disks 220; 220'. Starting from the neutral position of the two switching mechanisms 200; 200', the force during closing is not sufficient for displacing the definition tips 112; 112'. Therefore, by way of example, the switching mechanism 200' can be operated by closing the second electrical contact 210' without displacement of the definition tip 112'. The second definition tip 112' is then located within the second guide 120', so that deflection of the second definition tip 112' is not possible, but rather only deflection and displacement of the first definition tip 112 are possible, when the first switching mechanism 200 is operated.

It is advantageous that the front part of the locking pin 110, specifically the definition tip 112; 112', is movably mounted. When an attempt is made to switch on the blocked electrical switch 200; 200', the definition tip 112; 112' positions itself transversely and braces itself between the moving electrical contact 210; 210' and the mating contour 121; 121' of the guide 120; 120'. As a result, switch-on is no longer possible at all. The rotary movement takes place as a result of a check at an additional part, the definition disk 220; 220' which is located on the moving electrical contact 210; 210'. It is likewise possible for the definition disk 220; 220' to be fitted to a switching shaft of the electrical switch 500; 500'. Depending on the state, this definition disk 220; 220' acts on the definition tip 112; 112' of the locking pin 110; 110'. The switch-on force of the blocked electrical switch 500; 500' acts on the mechanism of the locking apparatus 100; 100' and on the guide 120; 120' which can be located on the rear side of the switch housing of the electrical switch 500; 500'. Since the locking pin 110 is spring-mounted, it can always be centered by a spring 115 in the normal switching mode or after the handle of the electrical switch 500, which has withstood the switch-on attempt, is released. Therefore, a normal forward and backward movement of the locking pin 110 within its guide 120 is reliably ensured.

Owing to the redirection of force onto the guide 120 or the mating contour 121 of the guide 120, the mechanism of the mutual locking by way of the rocker 300 is subjected to less loading than in the case of force-fitting designs. The force is quickly braked over a short distance in a form-fitting manner. It is only necessary for the rotatably mounted definition tip 112 of the locking pin 110 to be of stable construction and, nevertheless, no wear on the rest of the mechanism is to be expected. Similarly, when insulation of voltage-carrying parts is necessary, it is possible to provide this insulation in a simple manner. It is possible to maintain air gaps and creepage distances in a relatively simple manner by way of the locking apparatus 100 according to an embodiment of the invention.

The patent claims of the application are formulation proposals without prejudice for obtaining more extensive patent protection. The applicant reserves the right to claim even further combinations of features previously disclosed only in the description and/or drawings.

References back that are used in dependent claims indicate the further embodiment of the subject matter of the main claim by way of the features of the respective dependent claim; they should not be understood as dispensing with obtaining independent protection of the subject matter for the combinations of features in the referred-back dependent claims. Furthermore, with regard to interpreting the claims, where a feature is concretized in more specific detail in a subordinate claim, it should be assumed that such a restriction is not present in the respective preceding claims.

Since the subject matter of the dependent claims in relation to the prior art on the priority date may form separate and independent inventions, the applicant reserves the right to make them the subject matter of independent claims or divisional declarations. They may furthermore also contain independent inventions which have a configuration that is independent of the subject matters of the preceding dependent claims.

None of the elements recited in the claims are intended to be a means-plus-function element within the meaning of 35 U.S.C. § 112(f) unless an element is expressly recited using the phrase "means for" or, in the case of a method claim, using the phrases "operation for" or "step for."

Example embodiments being thus described, it will be obvious that the same may be varied in many ways. Such variations are not to be regarded as a departure from the spirit and scope of the present invention, and all such modifications as would be obvious to one skilled in the art are intended to be included within the scope of the following claims.

What is claimed is:

1. A locking apparatus for a circuit breaker, comprising:
- a locking pin including a main body and a rotatably or displaceably mounted definition tip; and
- a guide including a mating contour,
  - the locking pin being movably mounted within the guide,
  - the rotatably or displaceably mounted definition tip being in alignment with the locking pin in a first position, such that the locking pin, together with the rotatably or displaceably mounted definition tip, is movable through the guide, and
  - the rotatably or displaceably mounted definition tip being immovable through the guide in a second position owing to deflection of the rotatably or displaceably mounted definition tip of the locking pin, wherein the rotatably or displaceably mounted definition tip is movable to the second position when only the main body, and not the rotatably or displaceably mounted definition tip, is located within the guide.

2. The locking apparatus of claim 1, wherein, in the second position, the locking pin is blocked in the guide by contact between the rotatably or displaceably mounted definition tip and a mating contour of the guide.

3. The locking apparatus of claim 2, wherein the rotatably or displaceably mounted definition tip is of cylindrical design in the first position.

4. The locking apparatus of claim 2, wherein the rotatably or displaceably mounted definition tip is of a conical design on a side averted from the main body.

5. The locking apparatus of claim 1, wherein the rotatably or displaceably mounted definition tip is of cylindrical design in the first position.

6. The locking apparatus of claim 5, wherein the rotatably or displaceably mounted definition tip is of a conical design on a side averted from the main body.

7. The locking apparatus of claim 1, wherein the rotatably or displaceably mounted definition tip is of a conical design on a side averted from the main body.

8. An electrical switch comprising:
- a switching mechanism including a moving switching element; and
- the locking apparatus of claim 1,
- the moving switching element including a definition disk to interact with the locking apparatus such that, in an event of locking, the definition disk is configured to move the rotatably or displaceably mounted definition tip of the locking apparatus to the second position.

9. The electrical switch of claim 8, wherein the moving switching element is a moving electrical contact or a switching shaft.

10. The electrical switch of claim 9, wherein the moving switching element cannot be closed in the second position of the rotatably or displaceably mounted definition tip.

11. The electrical switch of claim 9, wherein the rotatably or displaceably mounted definition tip, in the second position, is arranged between the moving switching element and the mating contour of the guide.

12. The electrical switch of claim 8, wherein the moving switching element cannot be closed in the second position of the rotatably or displaceably mounted definition tip.

13. The electrical switch of claim 8, wherein the rotatably or displaceably mounted definition tip, in the second position, is arranged between the moving switching element and the mating contour of the guide.

14. The electrical switch of claim 8, wherein the moving switching element cannot be closed in the second position of the rotatably or displaceably mounted definition tip since the locking pin is blocked in the guide by the contact between the rotatably or displaceably mounted definition tip and the mating contour of the guide.

15. An apparatus, comprising:
- a first electrical switch;
- a second electrical switch, at least one of the first electrical switch and the second electrical switch being the electrical switch of claim 8; and
- a rocker, connecting a first locking pin of the first electrical switch to a second locking pin of the second electrical switch, to ensure that only one of a first rotatably or displaceably mounted definition tip of the first electrical switch and a second rotatably or displaceably mounted definition tip of the second electrical switch is movable to a second position.

16. An apparatus, comprising:
- a first electrical switch;
- a second electrical switch, each of the first electrical switch and the second electrical switch being the electrical switch of claim 8; and a rocker, connecting a first locking pin of the first electrical switch to a second locking pin of the second electrical switch, to ensure that only one of a first rotatably or displaceably mounted definition tip of the first electrical switch and a second rotatably or displaceably mounted definition tip of the second electrical switch is movable to a second position.

* * * * *